US005940924A

United States Patent [19]

Williams et al.

[11] Patent Number: 5,940,924

[45] Date of Patent: Aug. 24, 1999

[54] REMOVABLY MOUNTED DECK BRUSH

[75] Inventors: Todd A. Williams, Aliso Viejo; Richard A. Williams, Dana Point, both of Calif.

[73] Assignee: S. C. Johnson Commercial Markets, Inc., Sturtevant, Wis.

[21] Appl. No.: 08/868,521

[22] Filed: Jun. 4, 1997

[51] Int. Cl.[6] ..... A47L 13/12

[52] U.S. Cl. ..... 15/115; 15/105; 15/114; 15/117; 15/118; 15/121

[58] Field of Search ..... 15/105, 106, 111, 15/114, 115, 117, 118, 121

[56] References Cited

U.S. PATENT DOCUMENTS

| | | | |
|---|---|---|---|
| 597,246 | 1/1898 | Pratt | 15/114 |
| 702,338 | 6/1902 | Boord | 15/105 |
| 1,035,250 | 8/1912 | Shannon | 15/117 |
| 1,282,780 | 10/1918 | Dunagan | 15/105 |
| 2,687,542 | 8/1954 | Turausky | 15/111 |
| 2,741,788 | 4/1956 | Shey | 15/121 |
| 4,100,642 | 7/1978 | Gabor | 15/114 |
| 4,528,712 | 7/1985 | Leibow | 15/118 |
| 4,809,386 | 3/1989 | Re | 15/114 |
| 5,071,489 | 12/1991 | Silvenis | 15/118 |

FOREIGN PATENT DOCUMENTS

| | | | |
|---|---|---|---|
| 99837 | 4/1962 | Norway | 15/114 |
| 696911 | 9/1953 | United Kingdom | 15/117 |

*Primary Examiner*—Randall E. Chin

*Attorney, Agent, or Firm*—Warren R. Bovee; Renee J. Rymarz

[57] ABSTRACT

A cleaning apparatus includes an elongated first handle having a first longitudinal axis, a proximal end and a distal end. The apparatus also includes a second handle having a second longitudinal axis, a proximal end and a distal end. A connector is adapted to removably connect the second handle to the first handle in such a way that the second handle can be moved along and rotated around the first axis. A first holder is coupled to the distal end of the first handle, and a second holder is coupled to the distal end of the second handle. A first cleaning implement is removably mounted to the first holder, and a second cleaning implement is removably mounted to the second holder.

5 Claims, 6 Drawing Sheets

REMOVABLY MOUNTED DECK BRUSH

BACKGROUND OF THE INVENTION

This invention relates to a cleaning apparatus, more particularly, to a cleaning apparatus which combines two or more cleaning implements, such as a brush and mop, and is suitable for cleaning various floors with rough and porous surfaces such as clay and concrete floor surfaces.

Floor mops have long been used to wash and clean floor surfaces. A typical mop implement usually comprises a bundle of fabric rags, yarns, or a sponge attached to the end of a handle. During a cleaning operation, the cleaner, or operator, first dips the absorbent material of the mop into a cleaning fluid (typically water with dissolved detergent) and then moves the mop back and forth on the floor surface to be cleaned. One problem with this type of mop implement is that, although it can efficiently wash smooth surfaces and remove loose litter or dirt, the mop can not efficiently remove tough ground-in dirt which is either built up in the grout lines of tiles or adhered on the surface because the absorbent material is too soft and the contact-area between the absorbent material and the floor surface is relatively large. In the case of a rough and porous floor surface, the situation becomes even worse because particles and other contamination tend to become stuck to the tiny cavities and pores on the floor surface. In many applications a rough and porous floor surface is preferred for certain purposes, such as slip protection. For example, the floor of a restaurant's kitchen is typically made of clay or concrete with rough surfaces to protect people from slipping. To maintain this kind of floor surface, the ground-in dirt and particles stuck to the porous surface must be periodically removed by manual scrubbing using a deck brush with sufficiently hard bristles. Preferably, a deck brush is used on such a floor at least once per day. However, in actual practice, a deck brush is used far less frequently, resulting in an unnecessarily slippery floor.

The combination of a mop and a brush into a single cleaning apparatus has been disclosed in the prior art, but solely for the purpose of allowing the user thereof to scrub scuff marks and other stains. In Canadian Patent No. 737,140, a combination floor mop is disclosed, which has a brush attachment actuable upon manual operation of the handle. By tilting the handle against the mop holder at different angles, the brush can be put in a position either in direct contact or out of contact with the floor surface. Therefore, the operator can chose to use the mop or the brush alone, or to use both of them at the same time. Although certain advantages have been achieved by this cleaning apparatus, it has several significant disadvantages. First, the positions of the mop and the brush relative to the floor surface to be cleaned can only be adjusted by tilting the handle against the mop holder. For example, when the handle is in a vertical position (the handle is perpendicular to the mop holder surface) the brush is brought out of contact with the floor surface, when the handle is in a substantially horizontal position (the handle is parallel to the mop holder surface) the brush is moved forward to be in direct contact with the floor surface. Thus, in order to conduct different operation mode, the operator must operate the cleaning apparatus at different angles between the handle and mop holder surface, and under certain angles it is very difficult and uncomfortable to operate. Secondly, the adjustable range of the brush is very limited.

U.S. Pat. No. 5,522,110 discloses a cleaning apparatus having a brush portion and an absorbent material portion amounted in the same base member, and a wringer is attached to the base member. The positions of the brush and the absorbent material relative to the floor surface are not adjustable. U.S. Pat. No. 5,584,091 discloses a similar cleaning system including a cleaning apparatus which has both a brush and a absorbent material attached to a single mop holder. Again, the relative positions of the brush and the mop are not adjustable. The disadvantage of the unadjustable brush and mop is that only one operation mode is available, and that it is not convenient to clean and replace the absorbent material and the brush.

A common problem of the combined mop and brush cleaning apparatuses disclosed in the prior art is that the relative positions of the brush and the absorbent material cannot be easily and independently adjusted for the purpose of providing different operation modes and an easy access to replacing and cleaning of the mop and the brush. Therefore, a need still exists for providing a cleaning apparatus for cleaning a floor surface, especially a rough and porous surface. Such cleaning apparatus should be readily adjusted to meet the cleaning requirements of different surfaces and can be cleaned and replaced with different parts easily.

SUMMARY OF THE INVENTION

The inventors have combined a mop and a brush into one cleaning apparatus so that the cleaning of both loose and stuck dirt or particles, as well as the washing/polishing can be done simultaneously with a single apparatus within one single operation. The cleaning apparatus of the present invention adjustable and removably combines two or more cleaning tools in an assembly for simultaneous surface washing/cleaning and deck brushing for various surfaces. The apparatus can also provide any two or more other cleaning tools with the tools being independently adjustable and removable so that different parts of the cleaning apparatus can be replaced and cleaned easily. While a preferred embodiment of the present invention combines a mop and a brush, any two or more cleaning implements can be readily combined, including squeegees, sponges, dustcloths, etc.

The apparatus of the present invention can be used for cleaning floors with tough dirt, stuck litter and oil stains. The cleaning apparatus is especially suitable for cleaning industrial floors such as the floors of restaurant's kitchens which usually is made of clay or concrete with rough and porous surface to protect slipping. Advantageously, the cleaning apparatus of the present invention can perform surface cleaning and deck brushing functions simultaneously and conveniently by providing a mop and a brush being removably and adjustable installed in a single assembly.

The cleaning apparatus of the present invention comprises:

- an elongated first handle having a first longitudinal axis, a proximal end and a distal end;
- a second handle having a second longitudinal axis, a proximal end and a distal end;
- a connector adapted to removably connect the second handle to the first handle in such a way that the second handle can be moved along and rotated around the first axis;
- a first holder coupled to the distal end of the first handle;
- a second holder coupled to the distal end of the second handle;
- a first cleaning implement removably mounted to the first holder; and
- a second cleaning implement removably mounted to the second holder.

A cleaning apparatus according to another embodiment of the present invention comprises:

a first handle having a first longitudinal axis, a proximal end and a distal end;

a second handle having a second longitudinal axis, a proximal end and a distal end;

a connector adapted to removably connect the second handle to the first handle in such a way that the second handle can be rotated around a joint point between the second handle and the connecting member within a plane containing the first axis and the second axis;

a first holder coupled to the distal end of the first handle;

a second holder coupled to the distal end of the second handle;

a first cleaning implement removably mounted to the first holder; and a second cleaning implement removably mounted to the second holder.

The present invention also provides a connecting mechanism for connecting a first handle and a second handle, said first and second handles having cleaning tool connected to their distal end. The connecting mechanism comprises:

a lower portion with a longitudinal through hole for receiving the first handle;

an upper portion with a longitudinal hole for receiving the second handle;

a support piece for connecting the lower and upper portions;

whereby the first and the second handles are connected in such a way that the second handle can be positioned along the length of the first handle and rotated around the first handle.

DETAILED DESCRIPTION OF THE PREFERRED EMBODIMENTS

The cleaning apparatus of the invention comprises an elongated first handle with a distal end and a proximal end, and a second handle with a distal end and a proximal end, the distal ends of the first handle and the second handle are connected with a brush and a mop containing an absorbent material such as fabric yarns, rags or a sponge, respectively and exchangeable, through two separate base members or plates. The first handle and the second handle are removably and adjustably connected to each other through a connecting member in such a way that the second handle can be positioned and adjusted along the length of the first handle, and can be rotated around the first handle, and that the second handle can be rotated around its joint with the connecting member.

The structure of the apparatus allows easy adjustments regarding the relative positions of the first handle and the second handle, and thus the mop and the brush. Depending on the surface condition and the desired operation mode, either the first handle or the second handle can be brought further toward the floor surface so that only the brush or the mop is in direct contact with the surface during the cleaning, or the two handles can be adjusted in such a way that both the brush and the mop are in contact with the surface. This adjustment can be done readily during any cleaning process. Even within one operation mode, different cleaning effects can be achieved by manipulation of the angle and the position with which the cleaning apparatus is pushed toward the surface. Therefore, the cleaning apparatus of the present invention is suitable and convenient for various cleaning conditions.

Embodiment One

Figure 1:
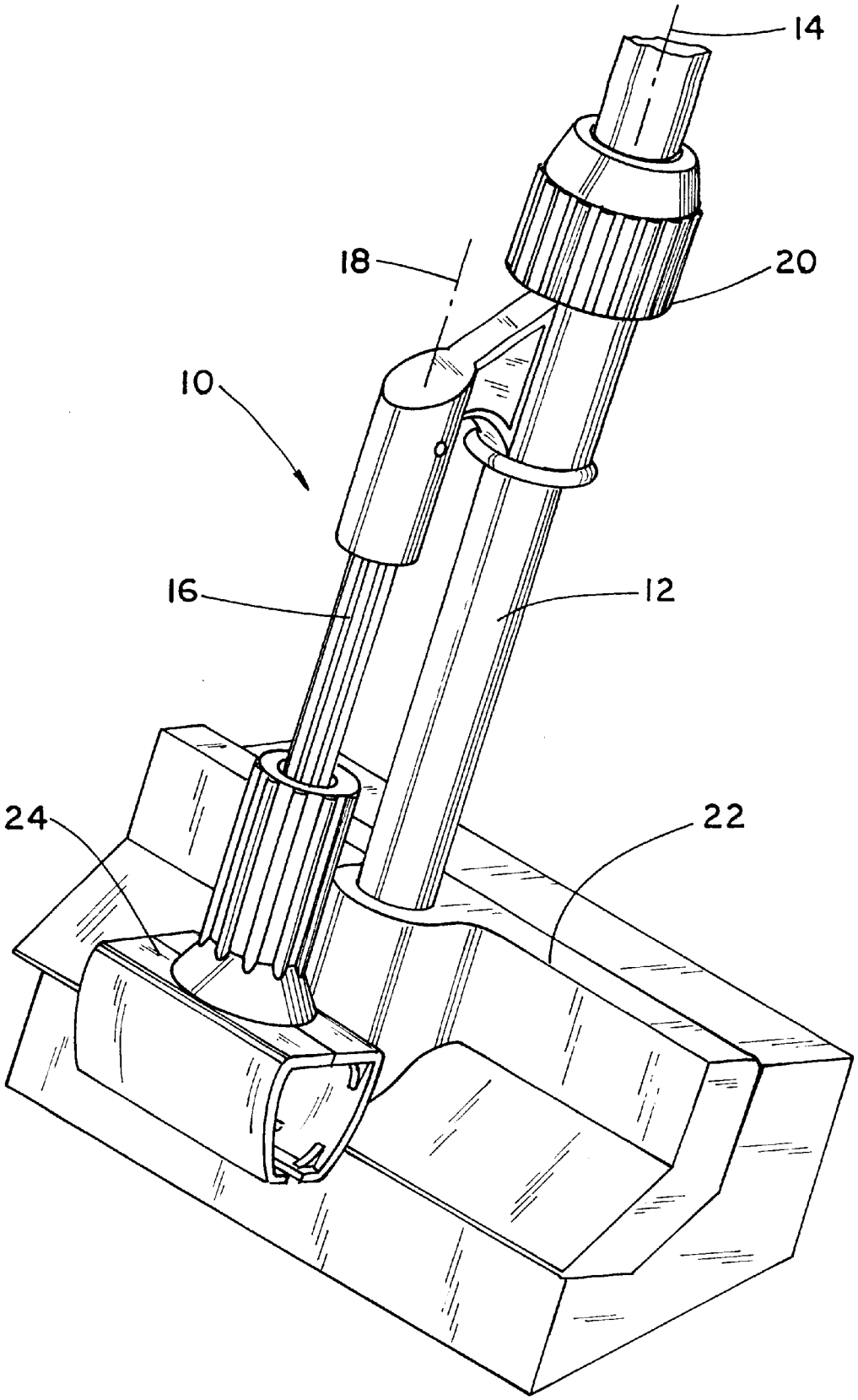
FIG. 1 is a perspective view of the cleaning apparatus according to one embodiment of the present invention.

Referring to FIG. 1, in this embodiment the cleaning apparatus 10 of the present invention has an elongated first handle 12 having a longitudinal axis 14, a distal end and a proximal end, and a second handle 16 having a longitudinal axis 18, a distal end and a proximal end. A connecting member 20 is employed to removably and adjustably connect the second handle to the first handle in such a way that the position of the second handle 16 can be adjusted along the length of the first handle 12 and that the second handle 16 can be rotated around the axis 14 of the first handle 12. A first holder 22 is removably mounted to the distal end of the first handle 12, and a second holder 24 is removably mounted to the distal end of the second handle 16. A cleaning tool such as a brush or a mop with absorbent materials (not shown) is coupled to the first holder 22, and a cleaning tool such as a mop and a brush (not shown) is coupled to the second holder 24. The first holder 22 is preferable to receive a brush, and the second holder 24 is preferable to receive a mop. The axis 14 of the first handle 12 preferably has an angle with the lower surface (not shown) of the brush, so that the cleaning apparatus can be operated comfortably and effectively. If any cleaning tool with a defined lower surface such as a brush or a sponge is used with the second holder, it is also desirable to provide an angle between the axis 18 of the second handle and said lower surface.

Figure 3:
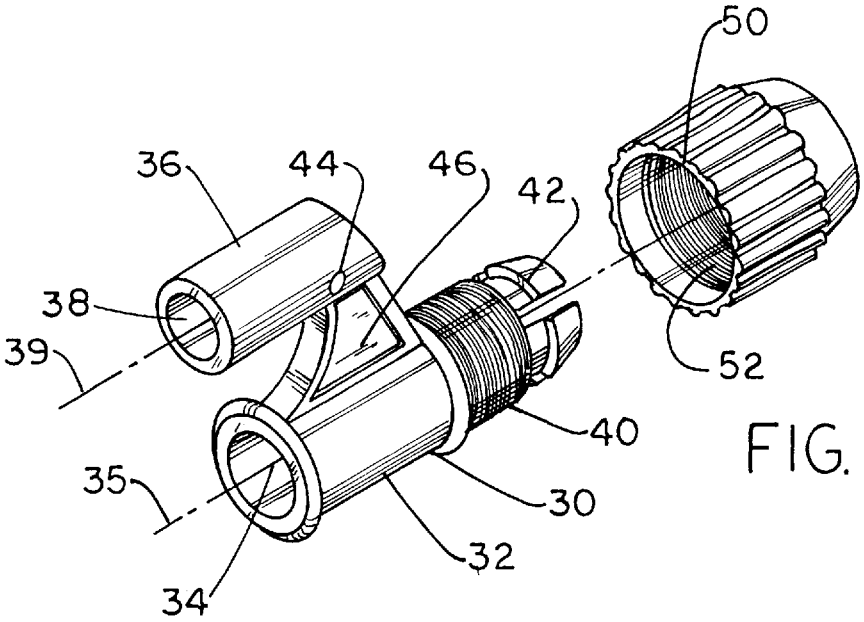
FIG. 3 is a perspective view of the connecting member shown in FIG. 1.

The connecting member 20, as shown in FIG. 3, has a handle attachment 30 and a lock nut 50. The handle attachment 30 has a lower tubular portion 32 with a longitudinal through hole 34 along an axis 35, an upper tubular portion 36 with a longitudinal hole 38 along an axis 39, and a support piece 46 connecting the upper and lower portions. Preferably, said axes 35 and 39 are substantially parallel to each other. The longitudinal hole 34 has an inner diameter slightly larger than the outer diameter of the first handle so as to provide a slide-fit between the handle attachment 30 and the first handle 12. The lower portion 32 also has a male thread 40 on its outer surface near one end. The thread 40 is followed by fastening legs 42 which are notched at their tips. Lock nut 50 is provided to lock the connecting member 20 to the first handle 12. The longitudinal hole 38 of the upper portion 36 has a diameter slightly larger than the outer diameter of the second handle 16. The upper portion 36 also has a through hole 44 perpendicular to the longitudinal axis of the hole 38 and passing through a diameter of the hole 38. A stress-release hole can be optionally provided next to the hole 44.

In practice of the present invention, the handle attachment 30 is slide-fit to the first handle 12 through the hole 34. Therefore, it can move along the length of the first handle 12, and rotate around the first handle freely. Once a desired position is achieved, the connecting member 20 can be fixed and fastened to the first handle 12 by means of the lock nut 50. Lock nut 50 has a female thread 52 which matches the male thread 40 of the handle attachment 30. By screwing in the lock nut 50, the fastening legs 42 are forced against the surface of the first handle 12, and the connecting member 20 is firmly secured to the first handle 12.

There are other ways of securing the first handle to the connecting member 20. For example, the connecting member 20 shown in FIG. 3 can modified so as to eliminate the lock nut 50, the thread 40 and the fastening legs 42. In this case two clamps are attached to the first handle 12 and the lower portion 32 of the connecting member 20 is held between the two clamps.

The proximal end of the second handle 16 can be conveniently secured to the upper portion of the connecting member 20 by a number of different ways. For example, the handle with a suitable shape can be slide-fit into the hole 38 and fastened with a screw or a dowel through hole 44. It can be also screwed into hole 38, in this case, the proximal end and the hole 38 should be threaded.

Figure 4:
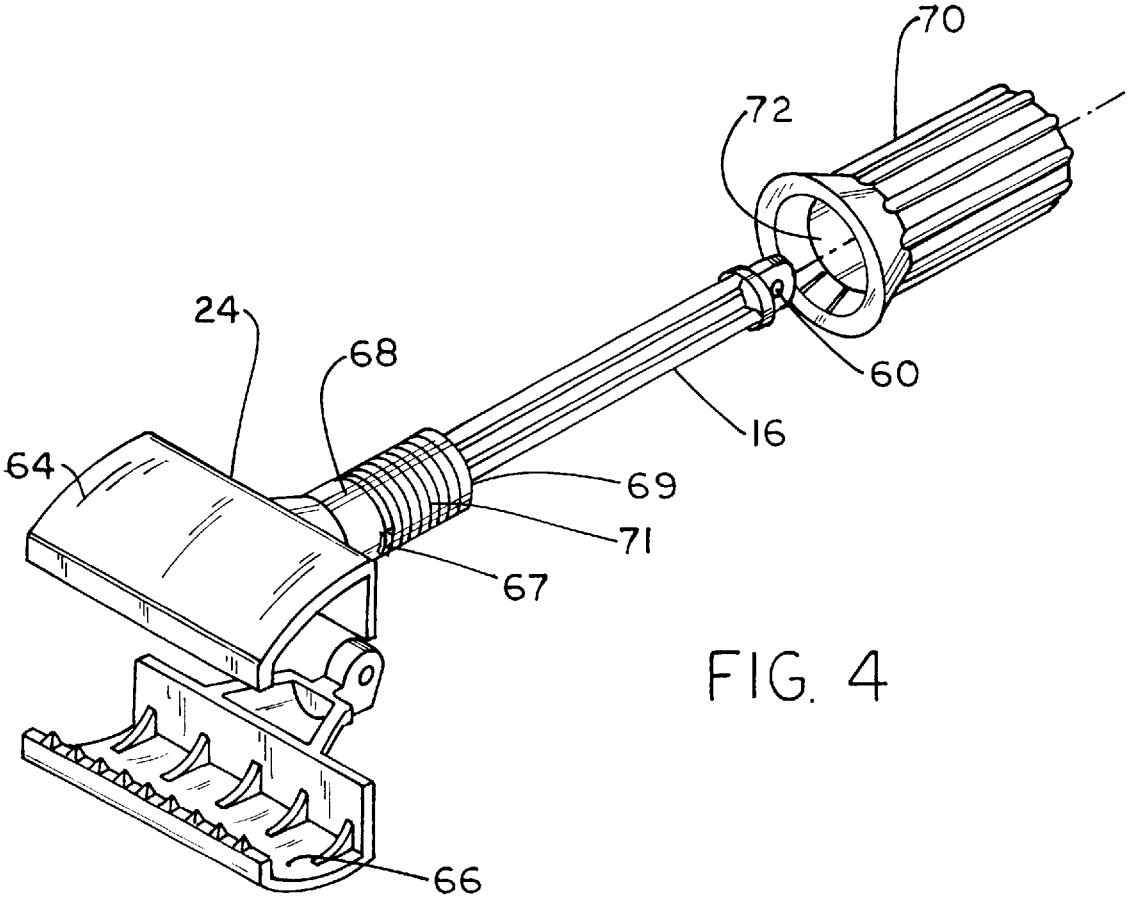
FIG. 4 is a perspective view of the second handle and the holder shown in FIG. 1.
Figure 5:
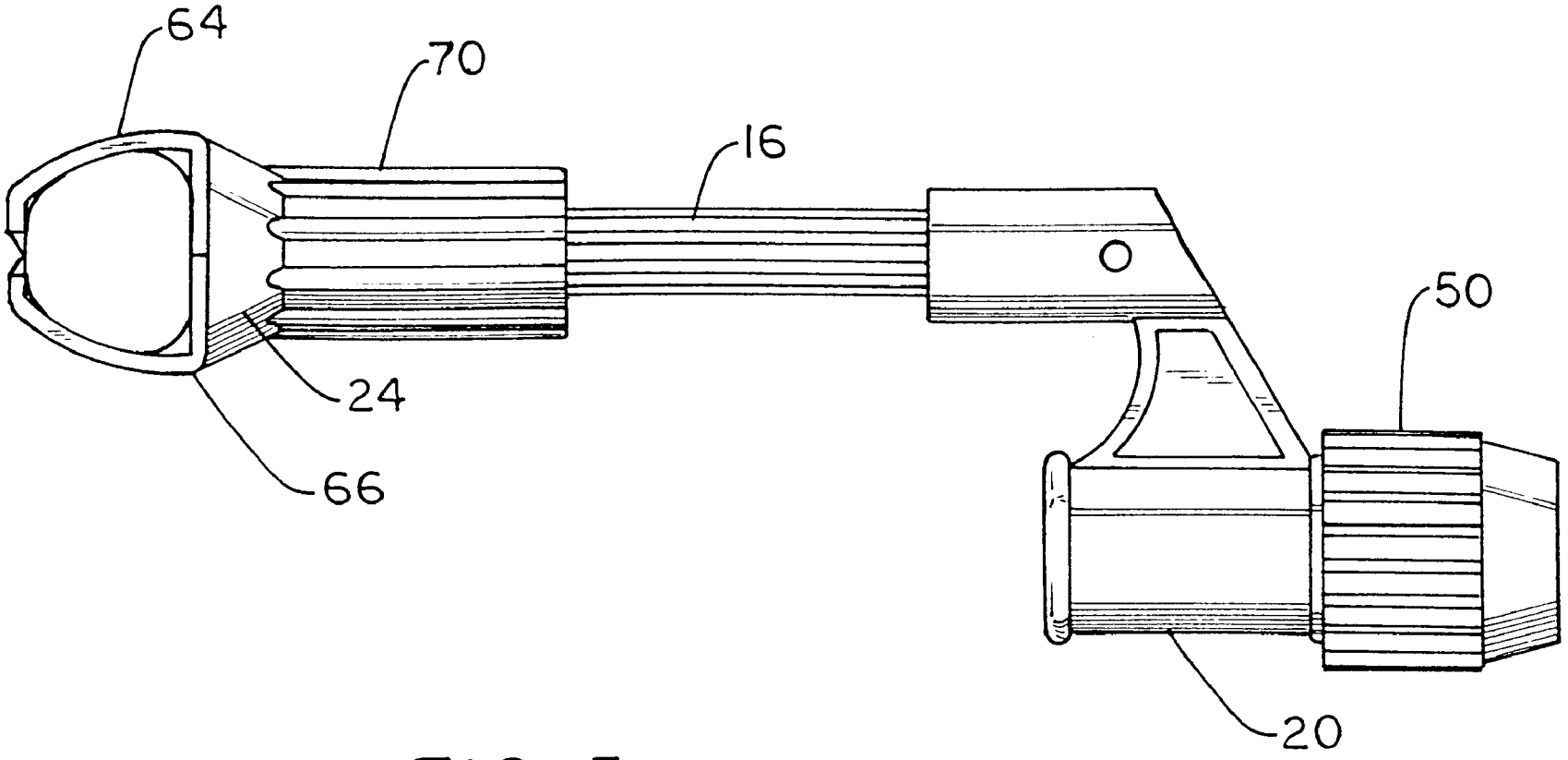
FIG. 5 is a perspective view of the assembly of FIG. 4 combined with the connecting member shown in FIG. 3.

FIG. 4 shows an example of second handle connected to a jaw. The second handle 16 has a hole 60 near its proximal end. Hole 60 is provided to match the hole 44 on the upper portion 32 of the handle attachment 30. The second handle 16 is attached to the handle attachment 30 by slide-fitting the proximal end of the second handle 16 into the hole 38 of the upper portion 36, and then fastened and secured by a bolt or a screw (not shown) passing through hole 44 and hole 60. Apparently, the second handle 16 and the handle attachment 30 can be mounted in various other ways, such as thread connection and clamp connection.

Figure 2:
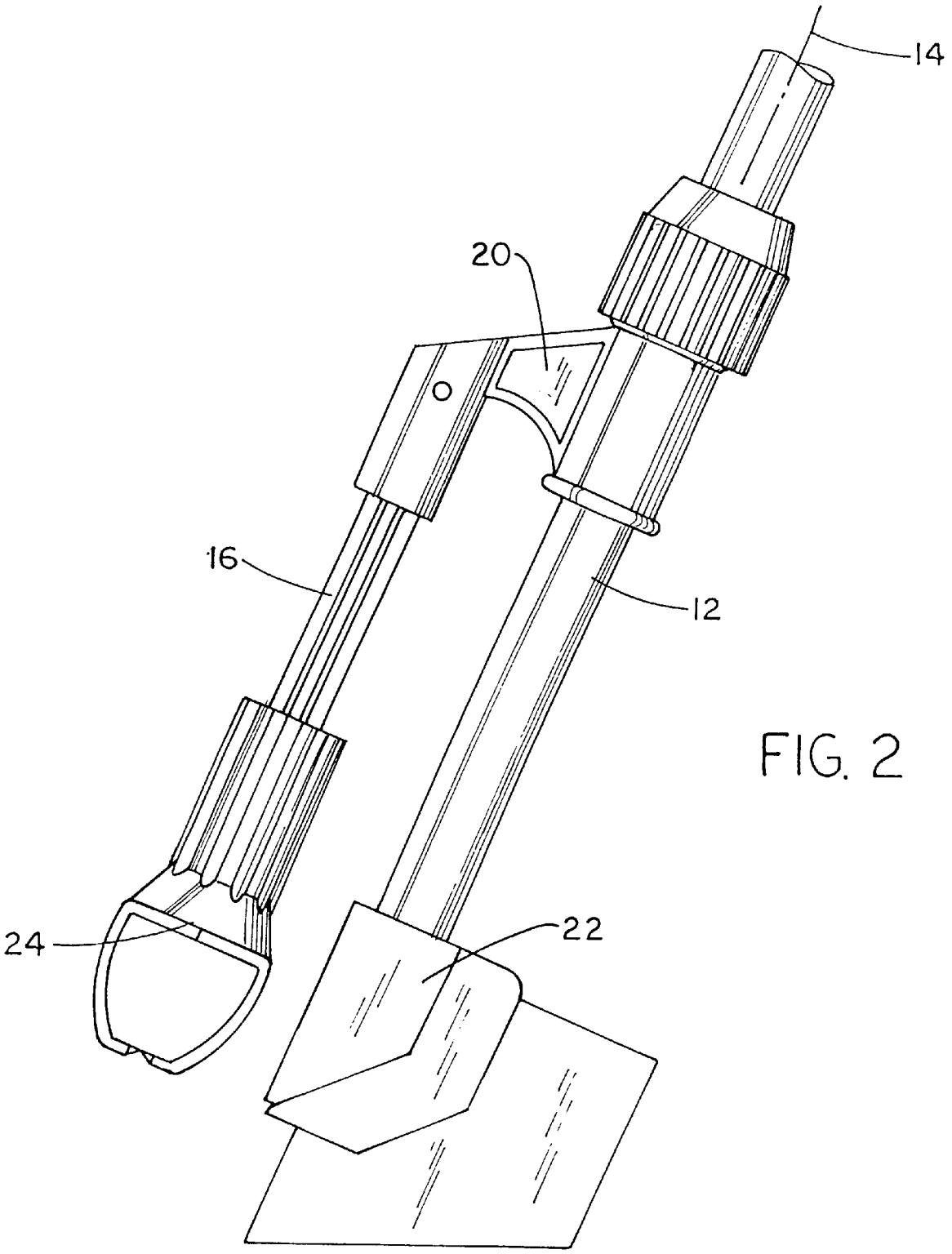
FIG. 2 is a side view of the cleaning apparatus shown in FIG. 1.

The distance between axis 35 and axis 39 (or between axes 18 and 14) is determined by the size of the support piece 46 of the handle attachment 30. This distance is important for effective operation, and is usually in the range of about 1 to 7, preferably about 1.5 to 5, more preferably about 2 to 3 inches. In one embodiment, this distance is about 2.5 inch with the diameter of the first handle being about 1 inch and a similar size of the second handle. If the distance is too small, it will be difficult to remove the parts such as the brush and the mop. On the other hand, if the distance is too large, it will occupy more space and increase the chance to damage the connecting part. It is preferable to have the first handle 12 and the second handle 16 in a parallel position under working conditions as shown in FIGS. 1 and 2, but the two handles can be positioned in various ways relative to each other. For example, the two handles can positioned in such a way that the longitudinal axes thereof form an angle. When the two handles are in a parallel position, the distance between the outer surfaces of the two handles can be in a range of about 0.0625 to 12, preferably about 0.5 to 6, more preferably 0.75 to 1.5 inches. In order to strengthen the connection between the second handle and the first handle, a support piece can be provided (not shown). For example, a support piece can be pivotally attached to the second handle 16 at a position between the distal end and the joint point with the connecting member 20. The other end of the support piece can be removably clamped to the first handle 12 at a corresponding position.

The connecting member 20 can be made of any materials known to the art, such as wood, metals and plastics. In this embodiment, it is made of plastics. There are different options for the connecting member 20. For example, instead of thread and lock nut connection as shown in FIGS. 3, a clamp connection can also be used.

The first handle 12 can be made of any material known to the art, such as wood, plastics, metals (steal and aluminum), and composite (fiberglass). The preferred diameter and length of the first handle 12 are about 1 inch and 60 inches. Of course, other sizes and shapes of the first handle 12 can also be used. Although the connecting member 20 can be positioned along the entire portion of the first handle 12, it is preferred to attach the connecting member 20 to the lower middle part of the first handle 12 (close to the distal end). In other words, the second handle 16 should be shorter than the first handle 12. Depending on the size of the second holder attached to the second handle 16 and the size of the connecting member 20, the length of the second handle 16 will vary, but preferably is in the range of about 5 to 30, more preferably about 7 to 15 inches. In this embodiment, the distance between the distal end and the proximal end of the second handle is about 9 inches. The cross sectional area of the second handle 16 can be any desired shape such as circle, oval and hexagon, and with a size similar to that of the first handle 12. The cross-section of the second handle 16 has a ribbed oval shape in this embodiment. The second handle 16 can be made of any materials known to the art such as wood, plastics, metals (steal and aluminum), and composite (fiberglass) with plastics being preferred.

The length of the lower portion 32 and the length of the upper portion 36 of the handle attachment 30 should be long enough to be able to hold the first handle 12 and the second handle 16 strongly and steadily. The distance from one end to the other end of the lower portion 32 may vary, but preferably is in the range of about 2 to 10, more preferably 2.5 to 6, most preferably 3 to 4 inches. The length of the upper portion 36 is preferably in the range of about 1 to 5, more preferably about 1.5 to 4, most preferably about 2 to 3 inches.

As shown in FIG. 1, a first holder 22 is removably attached to the distal end of the first handle 12 for receiving a cleaning implement. Any conventional cleaning implement can be used, such as a brush (not shown). The second holder 24 attached to the distal end of the second handle can be connected to and conventional cleaning implement, such as a super jaw (manufactured by Wyland Companies), a speed change, or a stirrup style.

As shown in FIGS. 1 and 4, in one example of the present invention a second holder 24, (in this embodiment it is a jaw holder) for receiving cleaning materials is connected to the distal end of the second handle 16 through the tail part 68 of the second holder 24. There is a longitudinal hole 69 in the tail part 68 for receiving the second handle 16. The connection between the tail part 68 and the distal end of the second handle 16 can be secured by male-female thread fitting, or by other conventional ways known to the art. In this embodiment, the connection is made through a bolt connection. There is a hole at the distal end of the second handle 16 similar to hole 60, and a hole on the tail part 68 similar to hole 44. By inserting a screw 67 through those holes, the distal end and the holder 24 are secured to each other. The outer surface of the tail part 68 has a male thread 71 to fit with the female thread 72 of the clamp nut 70. The clamp nut 70 is used to control the positions of the upper jaw 64 and the lower jaw 66. At one end of the clamp nut 70, it has a conical-shaped inner wall curved away from the axis 18.

When the clamp nut 70 is moved toward the jaw holder 24 by turning around the thread, the two jaws are forced to get closer to each other by the conical-shape wall at one end of the clamp nut 70, so that the cleaning material is held tightly between the upper jaw 64 and the lower jaw 66. When the cleaning material needs to be replaced, the clamp nut 70 is removed and the two jaws are forced to return to the separate position through a spring (not shown). The clamp nut 70 can be also used to help further secure the second handle 16 into the hole 69 in the tail part 68. In so doing, an optional ferrule (not shown) is used at the distal end of the second handle 16, i.e. when the clamp nut 70 is threaded toward the second holder 24, the second handle will be held tightly through the ferrule mechanism.

Apparently, different kinds of devices can be used as the holder such as a plate, a clamp, and different cleaning materials can be used, such as a mop or a sponge. It is also possible to switch the cleaning device between the two handles, i.e. the brush can be connected to the second handle, and the mop can be connected to the first handle, or both handles are connected with a mop or a sponge, or both are connected to a brush.

Any conventional sizes of brushes and mops known to the art can be used in this invention. There are many possible combinations of a brush and a mop with different size depending the desired purpose and surface conditions. For example, if the surface to be cleaned has tough dirt, a smaller brush may be desirable because smaller brush will result in a larger pressure when same force is applied to the handle.

In another variation of the cleaning apparatus according to the present invention, the second handle 16 and the connecting member 20 can be molded into a single piece. The second handle 16 and the second holder 24 can also be molded into a single piece.

Embodiment Two

Figure 6:
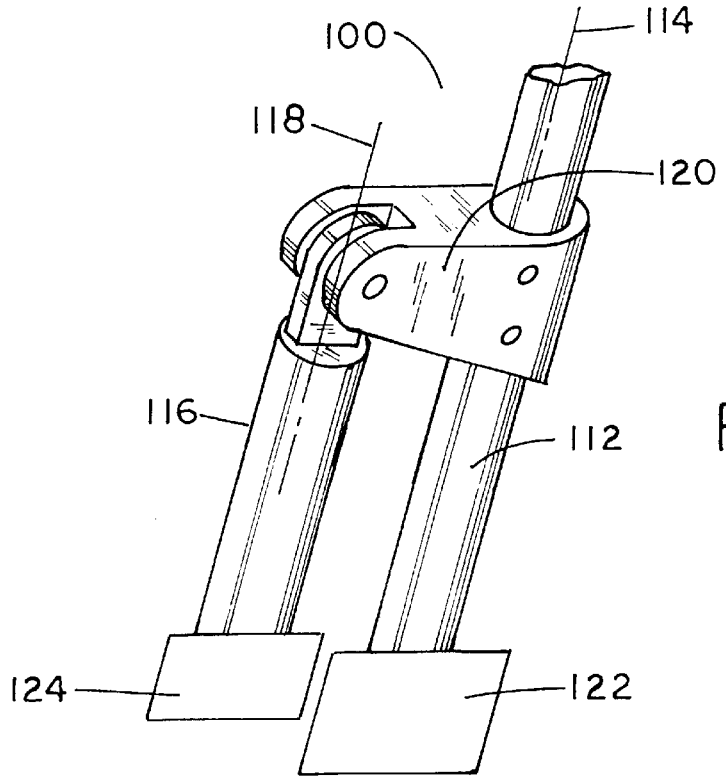
FIG. 6 is a perspective view of the cleaning apparatus according to another embodiment of the present invention.

As shown in FIG. 6, in another embodiment of the present invention, the cleaning apparatus 100 comprises: an elongated handle 112 having a longitudinal axis 114, a second handle 116 having a longitudinal axis 118, a connecting member 120 being employed to removably connect the second handle 116 to the first handle 112, a first holder 122 being removably mounted to the distal end of the first handle for receiving cleaning and absorbent material such as a brush, a second holder 124 being removably mounted to the distal end of the second handle for receiving cleaning and absorbent material such as a mop or a sponge, a brush or other cleaning material (not shown) being coupled to the first holder 122 and, a cleaning material, such as a mop, a sponge or a brush (not shown) being coupled to the second holder 124.

Figure 7:
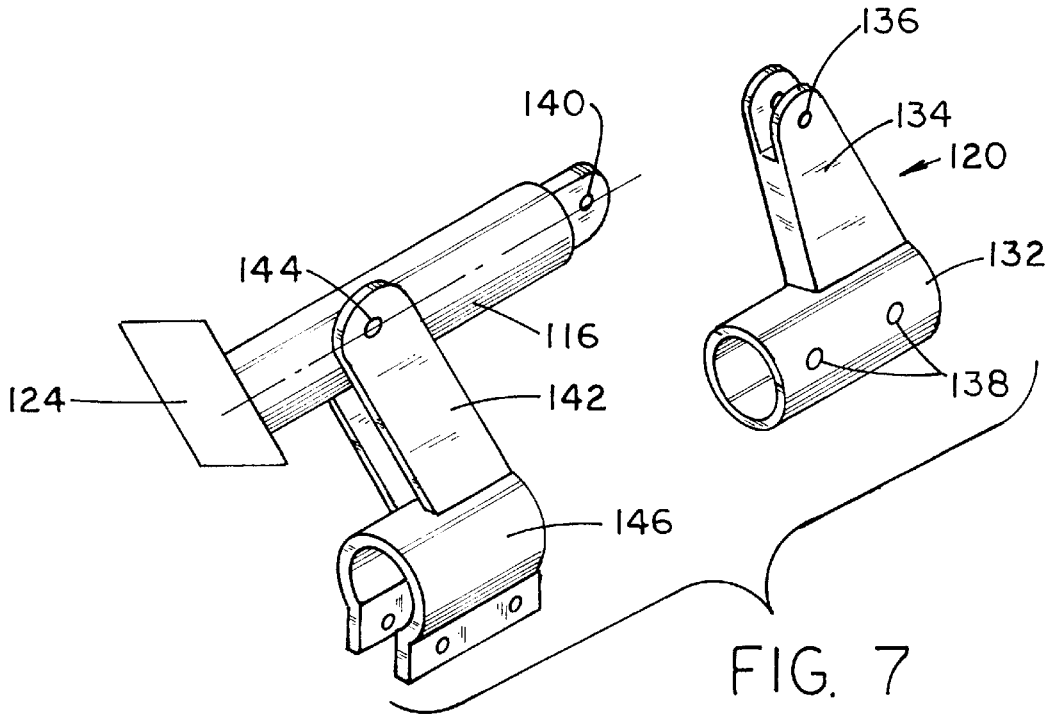
FIG. 7 is an exploded perspective view of the second handle and the connecting member shown in FIG. 6.

Referring to FIG. 7, the connecting member 120 has a collar 132 that fits around and holds the first handle 112, an extending piece 134 that extends away from the collar 132 and, a pivoting member 136 that is pivotally connected to the proximal end of the second handle 116. The collar 132 has an inner diameter slightly larger than the outer diameter of the first handle 112, and two threaded holes 138 which are used to fasten the collar to the handle with two fastening screws. The connecting member can be freely moved along and around the first handle 112 when the fastening screw is untight. Once a desired position of the collar is located, the screws are fastened and the collar is fixed onto the handle. The proximal end of the second handle 116 is made in a proper shape to fit the pivoting member 136, and has a hole 140 to receive a bolt or a screw passing both hole 140 and hole 137. Thus, the second handle 116 can move around the bolt, which makes it very convenient to take parts off and to replace parts. The structure described above allows one to adjust the position of the second handle 116 along the first handle 112, rotate the second handle around the first handle 112, and rotate the second handle 116 around the joint with the extending piece 134 within a plane containing the first axis 114 and the second axis 118. In order to hold the second handle 116 in a working position, a support piece 142 is provided. One end of the support piece 142 is pivotally connected to the second handle 116 through bolt 144 as shown in FIG. 7, the other end of the support piece 142 has a clamp 146 for holding the first handle. To determine the working position of the two handles, different length of the support piece 142 can be used. It is preferred to have the axis 118 of the second handle parallel to the axis 114 of the first handle, but an angle between the two axes is also acceptable.

It is clear that many other options are available for the structure of the connecting member and for the way of connecting different parts. For example, the lock nut unit shown in FIG. 3 can be used here in the collar 132. The pivotal connection between the second handle and the connecting member can be modified by adding a fastening device so that, when the second handle is rotated to a desired position, it can be locked.

The way to connect the cleaning and absorbent material such as a brush, a mop or a sponge to the handles in this embodiment is similar to that discussed in the previous embodiment.

Figure 8:
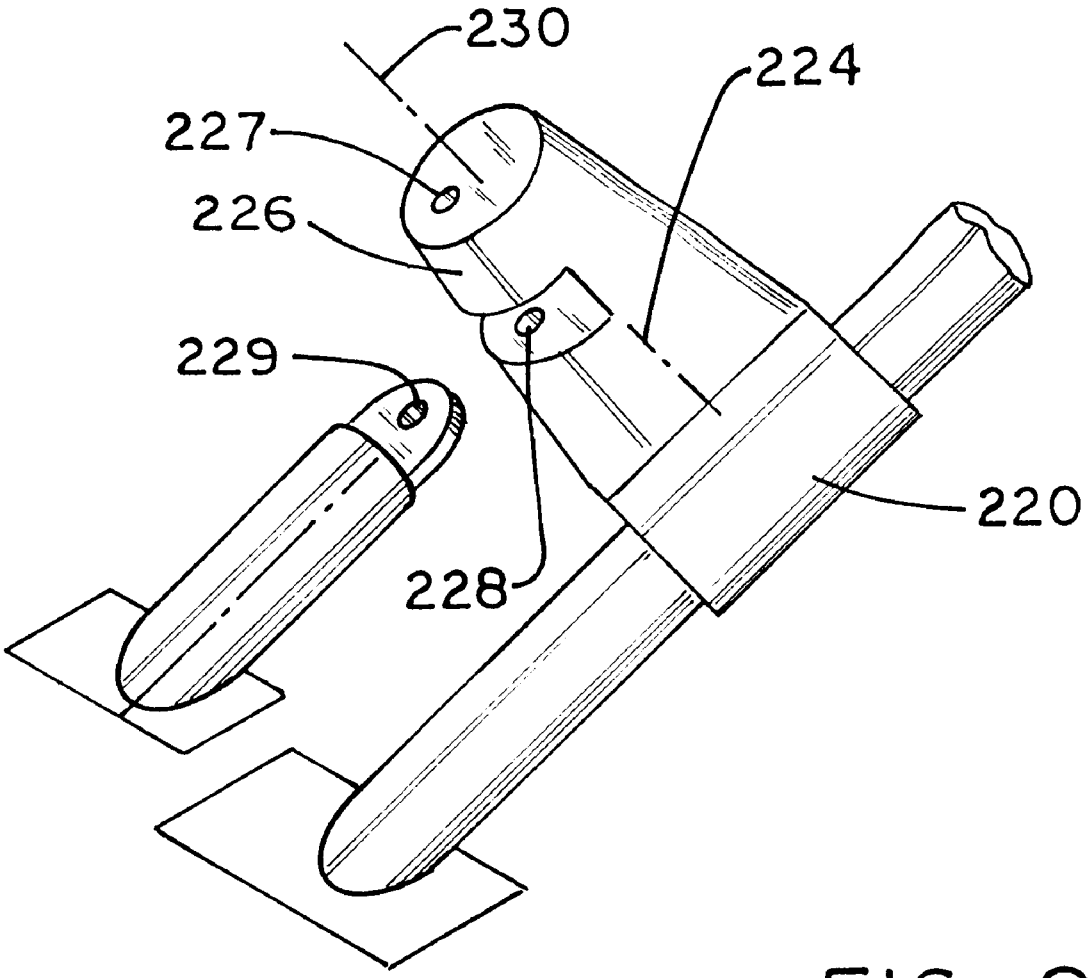
FIG. 8 is an exploded perspective view of the second handle and the connecting member with different orientation as shown in FIG. 7.

Referring to FIG. 8, it is also possible to connect the distal end of the second handle to the connection member in such a way that the second handle can be rotated around the longitudinal direction (axis 230) of the extending piece 224 of the connecting member 220. This can be easily done by having a pivoting member 226 with a proper orientation. The hole 227 and hole 228 of the pivoting member 226 match with the hole 229 on the proximal end of the second handle 116. A screw bolt (not shown) can be used to pass through those holes and, thus, to connect the second handle 116 to the connecting member 220.

Another possible modification to the cleaning apparatus according to the present invention is to combine a vacuum into the system. A tube connected to a vacuum cleaner or a liquid vacuum pump can be easily mounted to the cleaning apparatus if desired.

In using the cleaning apparatus of the present invention, an operator first chooses the cleaning and absorbent material to be used for certain purposes, then installs them (a brush, a mop, or a sponge) to the distal ends of the first handle and the second handle, followed by adjusting relative position of the two handles with the connecting member. Once the desired position is achieved, all the fastening means is tightened and the second handle is fixed relative to the first handle. Usually a cleaning fluid (such as water with detergent) is used to facilitate the cleaning process. The mop and the brush or other cleaning material held at the distal ends of the two handles are dipped into the cleaning fluid usually contained in a bucket, then the mop and the brush absorbed with cleaning fluid are moved back and forth around the floors to be cleaned. The brush scrubs the floor to remove the dirt from the rough and porous surface, and the mop cleans the surface. It is particularly effective in dealing with rough clay or concrete surfaces such as those often encountered in restaurants' kitchens. After certain period time of operation, the mop and the brush connected to the handles are placed into the bucket to rinse accumulated dirt and debris from the cleaning materials of the mop and the brush, sometimes a wringer is used to clean and squeeze the moisture away from the absorbent material. During the cleaning, if it is desired to change the operation mold, this can be done very easily by moving the second handle along the longitudinal direction of the first handle so that one holder can be raised above the other which leads to the operation mold where only one of the mop and brush is in working condition, the other is out of touch with the floor. If nay parts need to be replaced, the second handle can also be rotated away from the first handle so that more room is available.

It will be obvious to those skilled in the art that changes and modifications could be made to the present invention described above within the scope and spirit of the present invention. It should be understood that the present invention is not limited by the specific embodiments.

What is claimed is:

1. A cleaning apparatus comprising:

an elongated first handle having a first longitudinal axis, a proximal end and a distal end;

a second handle having a second longitudinal axis, a proximal end and a distal end;

a connector adapted to removably connect the second handle to the first handle in such a way that the second handle can be moved along and rotated around the first axis as well as locked thereto;

a first holder coupled to the distal end of the first handle;

a second holder coupled to the distal end of the second handle;

a first cleaning implement removably mounted to the first holder;

a second cleaning implement removably mounted to the second holder;

wherein the connector comprises a lower tubular portion having a longitudinal through hole for receiving the first handle, an upper tubular portion having a longitudinal axis and a hole along the axis for receiving the second handle, a support piece connecting the lower portion and the upper portion wherein the connector further comprises a lock nut having a female thread, the lower portion has a male thread on its outer surface near one end of the lower portion and fastening legs extending along the first axis from the same end.

2. The cleaning apparatus of claim 1, wherein the upper portion further comprises two through holes perpendicular to the longitudinal axis and passing through a diameter of the hole along the longitudinal axis, the distal end of the second handle has a hole which matches the two holes, a screw is used to pass through those three holes and secure the second handle to the connector member.

3. The cleaning apparatus of claim 1, wherein the second holder is a jaw holder.

4. The cleaning apparatus of claim 1, wherein both the first cleaning implement and the second cleaning implement are selected from the group consisting of a mop and a brush.

5. The cleaning apparatus of claim 4, wherein the first cleaning implement is a brush and the second cleaning implement is a mop.

* * * * *